United States Patent [19]

Sato et al.

[11] Patent Number: 4,685,980

[45] Date of Patent: Aug. 11, 1987

[54] METHOD FOR IMPROVING THE MAGNETIC PROPERTIES OF FE-BASED AMORPHOUS-ALLOY THIN STRIP

[75] Inventors: Takashi Sato; Toshio Yamada, both of Kawasaki, Japan

[73] Assignee: Nippon Steel Corporation, Tokyo, Japan

[21] Appl. No.: 828,948

[22] Filed: Feb. 12, 1986

[62] Division of Ser. No. 729,298, May 1, 1985.

[30] Foreign Application Priority Data

May 4, 1984 [JP] Japan ..... 59-89947
Jul. 19, 1984 [JP] Japan ..... 59-148569

[51] Int. Cl.[4] ..... H01F 1/04

[52] U.S. Cl. ..... 148/304; 428/611; 336/213; 336/233

[58] Field of Search ..... 148/31.55, 403, 304, 148/4, 100, 121, 113; 428/611; 336/213, 233

[56] References Cited

U.S. PATENT DOCUMENTS

| | | | |
|---|---|---|---|
| 4,293,350 | 10/1981 | Ichiyama et al. | 148/111 |
| 4,321,090 | 3/1982 | Datta et al. | 148/31.55 |
| 4,363,677 | 12/1982 | Ichiyama et al. | 148/111 |
| 4,437,907 | 3/1984 | Sato et al. | 148/31.55 |
| 4,456,812 | 6/1984 | Nieheisel et al. | 219/121 LM |
| 4,529,457 | 6/1985 | Kushnick | 148/31.55 |
| 4,554,029 | 11/1985 | Schoen et al. | 148/112 |

FOREIGN PATENT DOCUMENTS

| | | | |
|---|---|---|---|
| 57-161025 | 10/1982 | Japan | 148/121 |
| 59-23822 | 2/1984 | Japan | 148/121 |

*Primary Examiner*—John P. Sheehan
*Attorney, Agent, or Firm*—Kenyon & Kenyon

[57] ABSTRACT

The watt-loss of the Fe-based amorphous alloy-thin strip is decreased by locally melting the surface of thin strip and again vitrifying the melting parts. In addition, the magnetic flux density is enhanced by annealing the thin sheet after the local melting.

3 Claims, 10 Drawing Figures

METHOD FOR IMPROVING THE MAGNETIC PROPERTIES OF FE-BASED AMORPHOUS-ALLOY THIN STRIP

This is a division of application Ser. No. 729,298 filed May 1, 1985.

BACKGROUND OF INVENTION

1. Field of Invention

The present invention relates to a method for improving the magnetic properties, especially the watt loss, of an Fe-based amorphous alloy thin strip which is used as the core of an electric-power conversion device, such as a power transformer or a high-frequency transformer, etc.

2. Description of Related Art

Amorphous-alloy thin strip produced by rapid-quenching and solidifying the molten-state alloy has various excellent properties attractive for application purposes. Among the amorphous alloys, an Fe-based amorphous alloy has a high magnetic flux density and a low watt-loss and is hence being used as the material for various cores.

The low watt loss of amorphous alloys, especially an Fe-based amorphous alloy, is believed to be due to the lack of anisotropy, the low hysteresis loss due to lack of defects, such as crystal-grain boundaries and the like, the thin sheet thickness, and the low eddy-current loss due to the high resistivity. The eddy-current loss, in a broad sense, calculated by subtracting the direct-current hysteresis loss from the measured value of watt-loss, amounts to scores to hundreds of times the classical eddy-current loss calculated on the presumption of uniform magnetization. This indicates that the proportion of abnormal eddycurrent loss is great in the watt loss because the width of magnetic domains is great and hence the magnetization changes non-uniformly in the amorphous alloy.

In addition, the absolute value of the abnormal eddy-current loss and its proportion in the total watt-loss increase with an increase in thickness, according to studies by one of the present inventors. The sheet thickness of an Fe-based amorphous alloy is usually from 20 to 30 μm. In accordance with recent developments, however, the sheet thickness is being increased, for example, to 40 to 80 μm. To enable the magnetic properties of an Fe-based amorphous alloy to be fully utilized in the case of thin sheet, the abnormal eddy current loss should desirably be decreased.

Several methods are known in the field of grain-oriented silicon steel sheets to decrease the abnormal eddy-current loss. One of them is the scratching method, known, for example, from U.S. Pat. No. 3647575, wherein the surface of a silicon steel sheet is scored by means of a hard, pointed end of a tool, ball-pen, or the like to subdivide the magnetic domains. The assignees of this application tried to apply the scratching method to an amorphous alloy thin strip, but did not attain significantly improved results.

Another method is to laser-irradiate the grain-oriented silicon steel sheet so as to subdivide the magnetic domains. However, the laser-irradiating method, and also the scratching method, is not effective when the irradiated grain-oriented silicon steel sheet is stress-relief annealed.

Narita et al report in "Proceedings of 4th International Conference on Rapidly Quenched Methods (1982)", pp 1001 to 1004 the effect of linear strain on the watt-loss, the linear strain being introduced into an annealed Fe-based amorphous alloy thin strip by means of scoring the surface of the strip by means of a diamond needle. According to this report, the strain is effective for reducing the watt-loss at a high-frequency region of 5 kHz or more, but is detrimental to the watt-loss at a low-frequency region of 100 Hz or less. The watt-loss at a low-frequency region is important for a power transformer or the like. Presumably, the ineffectiveness of the strain at the low-frequency region is attributable to the fact that the amorphous alloy inherently has a lower eddy current loss than the silicon steel sheets because of the thin sheet thickness and thus the subdivision of magnetic domains is only slightly effective for decreasing the watt loss. Rather, the strain presumably increases the hysteresis loss and hence the total watt-loss.

In order to decrease the watt loss of amorphous materials, it has been proposed in Japanese Unexamined Patent Publication (Kokai) No. 57-97606 to locally crystallize the materials. This publication discloses to form crystallized regions on the amorphous alloy thin strip along its width in the form of lines or rows of spots. The crystallization methods disclosed are irradiating by laser light or electron beam or conducting current through a metal needle or edge, located in the vicinity of or contact with the thin strip, to heat the thin strip. Japanese Unexamined Patent Publication (Kokai) No. 57-97606 discloses an improved watt-loss at a commercial frequency. Narita et al, who also report formation of linear crystallized regions, allege that such formation broadens the frequency region where the watt-loss is decreased to a low-frequency side, as compared with the scratching method. Nevertheless, according to Narita et al, the formation of linear crystallized regions is ineffective for decreasing the watt-loss or even impairs the watt-loss at a frequency of 200 Hz or less.

Japanese Unexamined Patent Publication Nos. 56-44710 and 56-44711 disclose to irradiate an amorphous alloy by laser light so as to decrease the watt-loss methods other than crystallization. The disclosed methods are effective for decreasing the watt-loss but slightly impair the excitation characteristic. The excitation characteristic is generally represented by the intensity of exciting current required for obtaining a predetermined intensity of magnetic flux density, i.e., an effective exciting current (VA), but is more conveniently expressed by the magnetic flux density (B) induced by a predetermined intensity of magnetic field (H). When the intensity of magnetic field (H) is 1Oe, the excitation characteristic is $B_1$. It appears that the local strain generated by the laser-light irradiation induces vertical anisotropy and thus impairs the excitation characteristic.

In the case of a grain-oriented silicon steel sheet, the principal aim of applying the scratching or laser-irradiating method to the sheet is to improve the watt-loss characteristic. The impairment of the excitation characteristic due to such application is considered inevitable. In the case of an amorphous alloy, so far as the above-mentioned publications and report are concerned, no improvement of the excitation characteristic by the laser-irradiation is disclosed. If it is attempted to restore the impaired excitation characteristic by means of stress-relief annealing, an effect of the laser upon watt-loss disappears.

SUMMARY OF THE INVENTION

It is an object of the present invention to provide a method for stably and considerably decreasing the watt-loss of an amorphous alloy.

It is another object of the present invention to provide a method for improving both the watt-loss and excitation characteristics of an Fe-based amorphous alloy.

In accordance with the objects of the present invention, there is provided a method for improving the magnetic properties of a thin strip of an Fe-based amorphous alloy, characterized in that the surface of the thin strip is locally and instantaneously melted and is subsequently solidified by rapid cooling to again vitrify the melted parts of the thin strip of amorphous alloy.

Another method provided by the present invention is to anneal the thin strip of Fe-based amorphous alloy subjected to the above mentioned method.

The thin strip of the Fe-based amorphous alloy subjected to the local and instantaneous melting may be an ordinary strip, cast one, or one treated for insulation or rust-proofing. The thin strip of Fe-based amorphous alloy subjected to the local and instantaneous melting may be then coated with a layer-insulation film.

The present invention also provides a core made of a thin strip of an Fe-based amorphous alloy subjected to the methods described above. One of the features of the core according to the present invention is that it has locally melted and then vitrified parts.

DESCRIPTION OF THE PREFERRED EMBODIMENTS

According to the present invention, the thin strip of an Fe-based amorphous alloy is produced by a conventional method, in which the melt is rapidly cooled to obtain glassified or vitrified alloy. The surface of amorphous alloy so formed is then melted locally and is again vitrified by rapid solidification. The cooling rate after the local melting determines whether the solidified substance becomes crystalline or amorphous. The cooling rate of the rapid cooling according to the present invention is generally $10^{4°}$ C./second or higher. The parts locally and instantaneously melted and subsequently solidified by rapid cooling are hereinafter referred to as the melted parts.

It is possible to clearly distinguish by means of an optical microscope or scanning-type electron microscope the parts which undergo solidification twice from parts which undergo solidification once. The melted parts have a distinct relative peripheral rise and the relative central depression.

It was verified by X-ray diffraction, the transmission type electron microscope, and the optical microscope that the melted parts formed by the laser-irradiation and their surrounding parts did not crystallize.

Narrowly focussed laser beam, preferably pulse-laser beam, is used to locally and instantaneously melt the surface of the thin strip of Fe-based amorphous alloy.

Figure 1A:
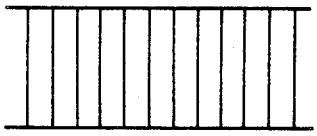
FIGS. 1(A), 1(B), 2, and 3 schematically illustrate a thin strip of Fe-based amorphous alloy which is locally melted for the revitrification according to the present invention.
Figure 1B:
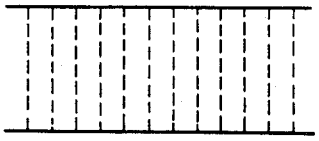
Figure 9:
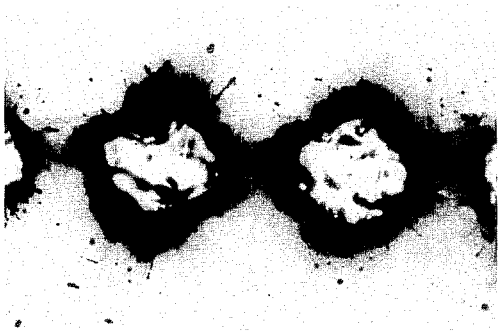

FIGS. 1A and 1B show preferred shapes and distributions of the melted parts. They are parallelly arranged lines or dots. The area and depth of the individual melted parts are determined so that neither they nor their surrounding parts crystallize during heating or during the resolidification step after melting. When crystallization occurs, the magnetic properties are generally impaired. The shape of the individual melted parts is generally round or oval such as shown in FIG. 9. When the melted parts are linear, the width of the lines is preferably 0.3 mm or less. When the melted parts are spots, the diameter of the spots is preferably 0.5 mm or less. If the size exceeds these values, the magnetic properties may be impaired.

The melted parts, which include their surrounding parts in this context, become depressed at their center and rise at their peripheries. The peripheral rise appears to result from an overflow of the melt due to the abrupt incidence of thermal energy by the laser irradiation, with the overflowing melt then solidifying at the peripheries.

In the case of using laser beam, the irradiation intensity, the beam diameter, the sweeping speed, the frequency of the pulse (in the case of a pulse-mode laser), and the like are parameters to be controlled. Specifically, the beam diameter is set as 0.5 mm or less. The irradiation intensity (laser power), the frequency, and sweeping speed are controlled so that the irradiation energy density per area of the melted parts ranges from 0.02 to 10 J/mm$^2$. The lowest irradiation energy density of 0.02 J/mm$^2$ in the one which can maintain the irradiation effect even after annealing. When the irradiation energy density exceeds 10 J/mm$^2$, the watt-loss characteristic is improved, but the excitation characteristic is impaired.

Figure 2:
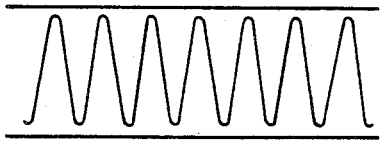
Figure 3:
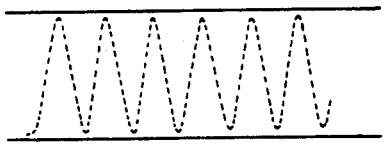

The melted parts in the form of lines or rows of dots may be directed along the width of a thin strip as shown in FIGS. 1(A) and 1(B). The directions may be slanted with respect to the width, provided that the slant angle is approximately 30° or less in average. Adjacent lines or rows need not be parallel to one another. The lines and rows need not be straight. The average distance between the adjacent lines and/or rows is preferably in the range of from 1 to 20 mm, and an average angle is preferably from 0° to 30° to appreciably reduce the watt-loss at a commercial frequency. The preferred average distance and angle depend upon the frequency at which the watt-loss characteristic is to be improved. Sinusoidal curves, such as shown in FIGS. 2 and 3, are also included in the arrangement of the melted parts according to the present invention, provided that the average distance between the adjacent curves and the angle of the curves are as described above.

Figure 4:
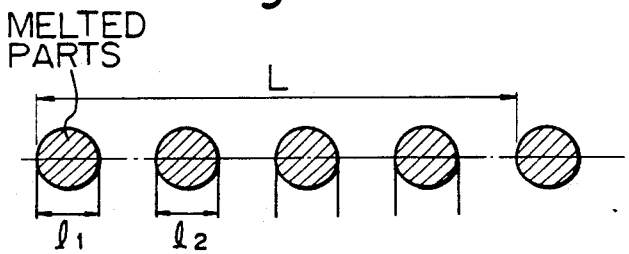
FIG. 4 illustrates an arrangement of the locally melted, rapidly cooled and solidified parts, as well as their distance.

A significant parameter of the melted parts for maintaining their effects after annealing is their distribution density (FIG. 4). The distribution is preferably such that the sum of the diameter of melted parts ($l=l_1+l_2+\ldots$) is 10% or more based on the total length L of the line or curve which constitutes the row of spots. If $l/L < 10\%$, the local strain is completely removed by the annealing.

The thin strip of an Fe-based amorphous alloy may be locally melted at any step before, during, or after the annealing. However, when the thin strip of an Fe-based amorphous alloy is first annealed and is then locally melted, the magnetic flux density ($B_1$) of the final product is decreased by a few percent (not exceeding 10%) as compared with that of the annealed product.

The optimum condition for local melting depends upon the step where the local melting is performed.

Figure 5:
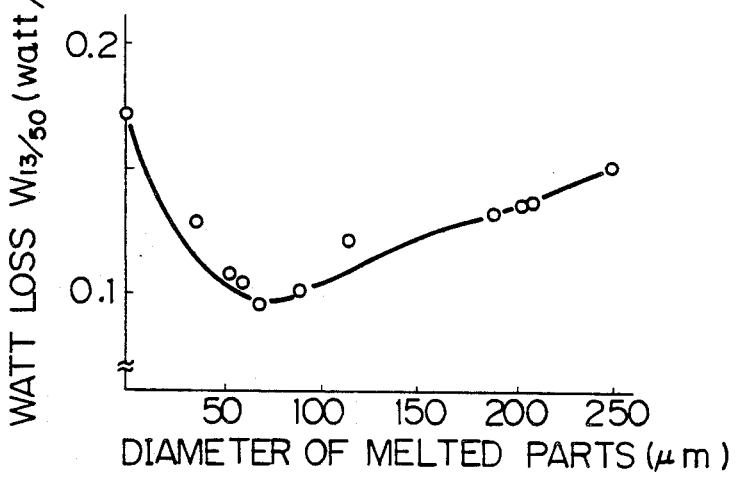
FIGS. 5 and 6 are graphs showing the relationships between the watt-loss ($W_{13/50}$) and the diameter of melted parts.
Figure 6:
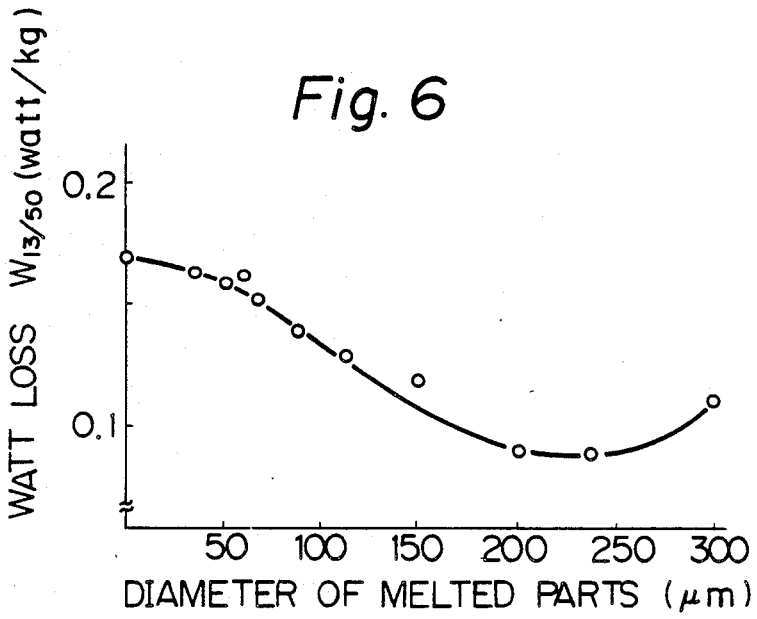
Figure 8:
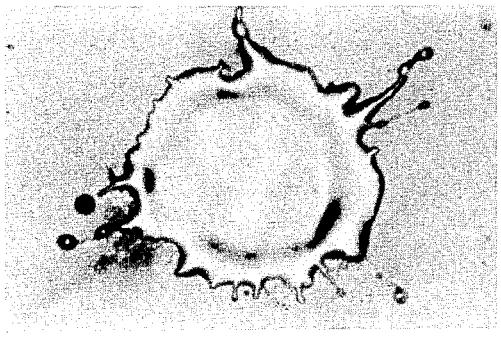
FIGS. 8 and 9 are photographs showing the metal structure of the locally melted, rapidly cooled and solidified parts.

FIGS. 5 and 6 illustrate the influence of the diameter of the melted parts upon the watt-loss ($W_{13/50}$) for cases of local melting at the step after annealing and the step before annealing, respectively. As is apparent from FIG. 5, the optimum spot diameter is from 50 to 100 μm for local melting after annealing, while, as is apparent from FIG. 6, the optimum spot diameter is from 200 to 250 μm for local melting before annealing. The difference in the optimum spot diameter appears to result from the relaxation of the melting effect occurring during annealing.

Annealing after the formation of melted parts is carried out under temperature and time conditions selected in accordance with the laser-irradiation conditions or the characteristics and distribution-density of the melted parts formed by the laser-irradiation. Optimum ranges of temperature and time for annealing are also dependent upon the composition of the Fe-based amorphous alloy.

The method for determining the optimum annealing conditions is as follows. The optimum annealing conditions are determined for the Fe-based amorphous alloy having the same composition but without the laser-irradiation. If the so-determined temperature is Ta, the optimum annealing temperature after the laser irradiation is higher than Ta, usually Ta+(10° C. to 40° C.). If the laser-irradiation is carried out under an intense or weak condition falling within a preferred range according to the present invention, the annealing temperature is selected high or low, respectively, in the range of Ta+(10° C. to 40° C.). It is difficult to indicate a temperature range applicable to all Fe-based amorphous alloys. Fe-based amorphous alloys includes the ones disclosed in U.S. Pat. No. 4,437,907 assigned to the present assignee and Japanese Unexamined Patent Publication (Kokai) Nos. 55-152,150, 55-158,251, and 54-148,122, referred to in U.S. Pat. No. 4,437,907 as prior art. In the case of a 65-μm thick amorphous thin sheet having a composition of $Fe_{80.5}Si_{6.5}B_{12}C_1$ (atomic %), the optimum annealing temperature of the non-irradiated thin sheet is 360° C. (within $N_2$ gas) under an annealing time of 60 minutes. When the above-mentioned amorphous thin sheet is treated by laser-irradiation to form the melted parts in the form of linear spots approximately 200 μm in diameter arranged in rows, spaced by 5 mm with a line density (l/L) of 70%, the optimum temperature is 380° C. (in $N_2$) for the annealing of the laser-irradiated thin sheet. The annealing time is also 60 minutes. An improvement in not only the watt-loss characteristic but also the excitation is attained by the annealing under the conditions described above. The annealing can be carried at the same time with the stress relief annealing of a wound core.

The method for forming the melted parts is irradiation by laser light for a short period of time. Other melting methods, such as irradiation by an electron beam, contact with high-temperature body, and local current conduction, are also effective for decreasing the watt-loss, if the melted parts are introduced into a thin strip of Fe-based amorphous alloy without incurring its crystallization.

Figure 7:
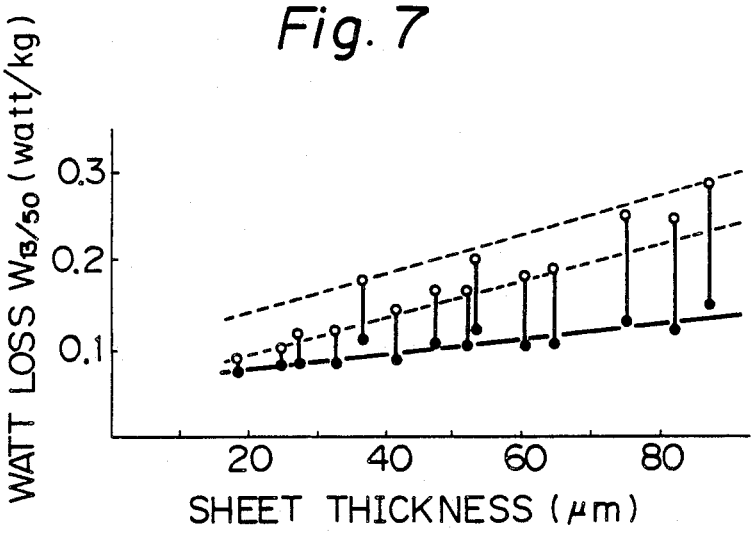
FIG. 7 is a graph showing the relationship between the watt-loss ($W_{13/50}$) and the sheet thickness.

The degree of improvement of the watt-loss characteristic depends upon the sheet thickness, as shown in FIG. 7, in which the o and • marks indicate $W_{13/50}$ before and after the irradiation, respectively. The watt-loss decrease is from 40% to 50% at the sheet thickness of 60 μm or more, while the watt-loss decrease is from 10% to 20% at the sheet thickness of 30 μm or less. The reason for the difference in the watt-loss reduction depending upon sheet thickness is because the width of magnetic domains increases in accordance with the increase in sheet thickness, and, therefore, the absolute value of an abnormal eddy-current loss and its proportion in the total watt-loss increase in accordance with the increase in sheet thickness. It was confirmed by observation with a scanning-type electron microscope that the magnetic domains of a 60-μm thick thin sheet are subdivided to those having $\frac{1}{3}$ the width.

The laser-irradiation on either the surfaces of amorphous alloy in contact or not in contact with the cooling roll for producing thin strip of amorphous alloy is also effective for improving the watt-loss and excitation-characteristics. After inducing the local strain an insulation coating, such as phosphate, chromic acid, and other anti-oxidants, may be applied on the surface of amorphous alloy sheet.

The present invention will now be explained by way of examples.

EXAMPLE 1

A 65-μm thick thin strip of amorphous alloy having the composition of $Fe_{80.5}Si_{6.5}B_{12}C_1$ was produced by a single-roll method. This thin strip was annealed at 360° C. for 60 minutes under a magnetic field in $N_2$ gas. The free surface (the surface not in contact with the single roll of rapid cooling) was locally melted by means of a YAG laser under the conditions of a pulse mode of 400 Hz and sweeping speed of 10 cm/sec. The melted parts were parallel to the width of the thin strip and formed spots in rows spaced at a distance of 5 mm. The size of the melted parts was controlled by adjusting the power of irradiation energy and the beam diameter. The watt-loss was measured by a single sheet tester. The relationship between the watt-loss ($W_{13/50}$) and the diameter of melted parts is shown in FIG. 5. As is apparent from FIG. 5, melted parts from 30 to 150 μm in diameter are greatly effective for decreasing the watt-loss ($W_{13/50}$). It was confirmed by means of irradiating the spot rows with X-rays through a 0.5-mm wide slit and observing the diffraction image that these melted parts and their surrounding parts did not crystallize.

EXAMPLE 2

The thin strip of amorphous alloy produced in Example 1 was subjected to the pulse-laser irradiation under the same conditions as in Example 1. The thin strip was then annealed at 360° C. for 60 minutes under a magnetic field within $N_2$ gas. FIG. 6 shows the relationship between the watt-loss ($W_{13/50}$) (after annealing) and the diameter of melted parts. The watt-loss ($W_{13/50}$) is the lowest at the diameter of the melted parts of approximately 200 μm. The melted parts were subjected, after the annealing in the magnetic field, to X-ray diffraction, as in Example 1. No presence of crystals was observed.

EXAMPLE 3

A 65-μm thick and 50-mm wide thin strip of an amorphous alloy having the composition of $Fe_{80.5}Si_{6.5}B_{12}C_1$ as produced by a single-roll method. The free surface (the surface not in contact with the single roll of rapid cooling) was locally melted by means of a YAG laser under the conditions of a beam diameter of 0.2 mm, a pulse mode of 400 Hz, a power of 5 W, and a sweeping speed of 10 cm/sec. The melted parts were parallel to the width of the thin strip and formed spots in rows spaced at a distance of 5 mm. Under observation by an optical microscope, it was found that the melted parts were round in shape, had an area of approximately 0.04 $mm^2$, and a line density (l/L) of approximately 70%. The irradiation energy density calculated is thus approximately 0.3 $J/mm^2$. It was confirmed by means of the X-ray diffraction and optical microscope-observation that the melted parts and their surrounding parts did not crystallize.

After the irradiation, the thin strip was annealed at 380° C. for 60 minutes under a magnetic field in $N_2$ gas.

For comparison purposes, a thin strip of amorphous alloy was annealed, without irradiation, at the optimum condition of 360° C. for 60 minutes under a magnetic field within $N_2$ gas. The results are shown in Table 1.

TABLE 1

| | Watt-loss ($W_{13/50}$) | Magnetic flux density ($B_1$) |
|---|---|---|
| Invention | 0.095 W/kg | 1.55 T |
| Comparative | 0.112 | 1.52 |

Note:
$W_{13/50}$ is the watt-loss at the frequency of 50 Hz and magnetic flux density of 1.3 T.

EXAMPLE 3

A thin strip having the same composition, width, and thickness as in Example 2 was subjected, in the "as cast" state, to YAG-laser irradiation to locally melt the free surface thereof. The irradiation conditions were: a frequency of 400 Hz, a beam diameter of 0.2 mm, a power of 5 W, a line speed of 2 cm/sec, and a beam sweeping speed of 10 cm/sec. The characteristics of the melted parts observed by the optical microscope were virtually the same as in Example 2. The irradiated thin strip in an amount of 1300 g was wound around a reel 120 mm in outer diameter and made of stainless steel and then annealed at 380° C. for 120 minutes under a magnetic field. During the temperature elevation up to 380° C., the temperature was held at 150° C. for approximately 120 minutes and raised at an average rate of approximately 3° C. per minute. The temperature drop was carried out by furnace cooling. The average cooling rate down to 250° C. was approximately 2° C. per minute.

For comparison purposes, the wound core was produced by using a non-irradiated thin strip of amorphous alloy having the same composition and shape as described above.

The magnetic properties are shown in Table 2.

TABLE 2

| | Watt-loss ($W_{13/50}$) | Effective excitation VA |
|---|---|---|
| Invention | 0.138 W/kg | 0.173 VA/kg |
| Comparative | 0.158 | 0.186 |

We claim:

1. A core of a transformer excited at a commercial frequency and made of a thin strip of an Fe-based amorphous alloy, characterized in that the surface of the thin strip is locally and instantaneously melted and is subsequently solidified by rapid cooling to again vitrify the melted parts of the thin strip of amorphous alloy.

2. A core of a transformer according to claim 1, characterized in that said thin strip of Fe-based amorphous alloy, which has been subjected to the local melting, is annealed.

3. A core according to claim 1, wherein said core is wound a core and is stress-relief annealed after forming the wound core.

* * * * *

UNITED STATES PATENT AND TRADEMARK OFFICE

CERTIFICATE OF CORRECTION

PATENT NO. : 4,685,980

DATED : August 11, 1987

INVENTOR(S) : T. Sato, et al.

It is certified that error appears in the above-identified patent and that said Letters Patent is hereby corrected as shown below:

ABSTRACT, line 3, change "melting" to --melted--.

Column 1, line 36, change "eddycurrent" to --eddy-current--.

Column 2, line 28, change "or contact" to --or in contact--.

Column 2, line 41, after "watt-loss" insert --by--.

Column 3, line 22, between "strip," and "cast" insert --a--.

Column 4, line 40, change "in" to --is--.

Column 5, line 44, change "includes" to --include--.

Column 8, line 39, change "wound a core" to --a wound core--.

Signed and Sealed this

Nineteenth Day of January, 1988

*Attest:*

DONALD J. QUIGG

*Attesting Officer*

*Commissioner of Patents and Trademarks*